United States Patent [19]

Whiteman et al.

[11] 4,014,447

[45] Mar. 29, 1977

[54] GRAPPLER SPREADER WITH OVERHEAD GRAPPLING ARM STORAGE

[75] Inventors: Donald R. Whiteman, Medina, Ohio; Dale H. Guthrie, High Point, N.C.

[73] Assignee: RPC Corporation, Roxboro, N.C.

[22] Filed: Nov. 20, 1974

[21] Appl. No.: 525,399

[52] U.S. Cl. ..... 214/620; 294/67 DA; 294/67 DB; 294/81 SF

[51] Int. Cl.[2] ..... B66F 9/18

[58] Field of Search ..... 214/620, 621; 294/67 R, 294/67 BC, 67 DA, 67 DB, 81 R, 81 SF

[56] References Cited

UNITED STATES PATENTS

| | | | |
|---|---|---|---|
| 3,151,904 | 10/1964 | Tantlinger et al. | 294/67 DA |
| 3,458,229 | 7/1969 | Nagy et al. | 294/81 SF |
| 3,558,172 | 1/1971 | Lamer et al. | 294/67 DA |
| 3,558,176 | 1/1971 | Fathauer | 294/67 R |
| 3,602,375 | 8/1971 | Martinson | 212/14 |
| 3,606,053 | 9/1971 | Whiteman | 214/621 X |
| 3,627,370 | 12/1971 | Whiteman et al. | 294/67 R |
| 3,713,556 | 1/1973 | Tredray | 214/621 |
| 3,863,970 | 2/1975 | Gottlieb et al. | 294/67 DA |

FOREIGN PATENTS OR APPLICATIONS

| | | | |
|---|---|---|---|
| 1,557,373 | 1/1969 | France | 294/67 DB |

*Primary Examiner*—L. J. Paperner
*Attorney, Agent, or Firm*—John H. Mulholland

[57] ABSTRACT

A grappler spreader adapted for mounting on a fork lift or other type of cantilever-loaded carrier, and for handling cargo containers and piggyback trailers. The spreader to be described is especially designed for use on front or side-loading carriers. It is advantageously used in stacking and unstacking closely placed containers in terminal yards through provision of grappling arms which may be stored above the main frame of a spreader within a vertical projection of a cargo container handled by the spreader.

8 Claims, 19 Drawing Figures

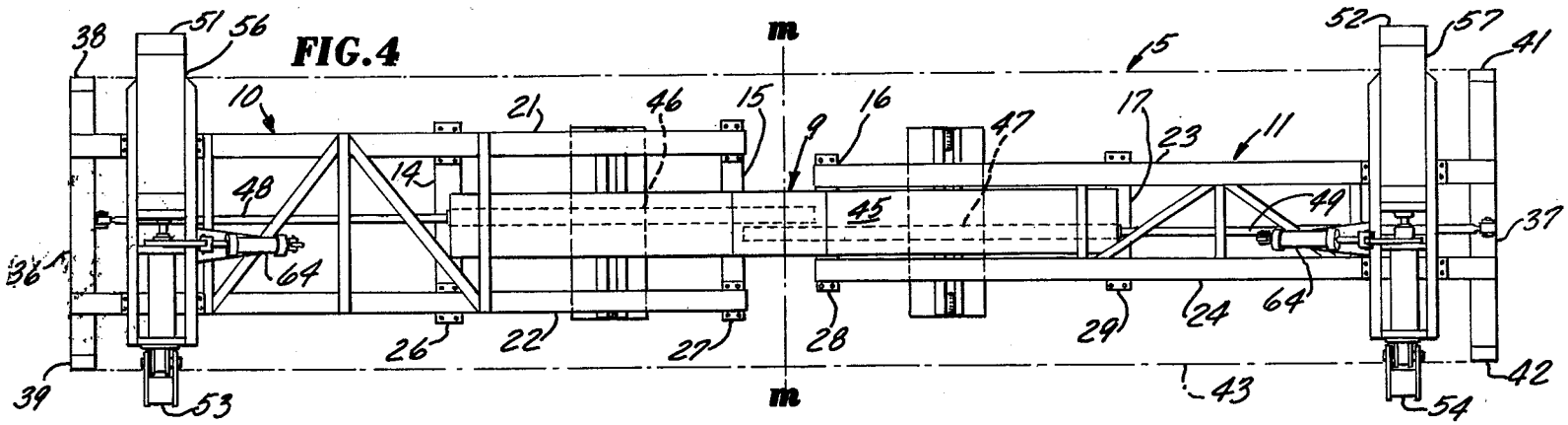
FIG.4
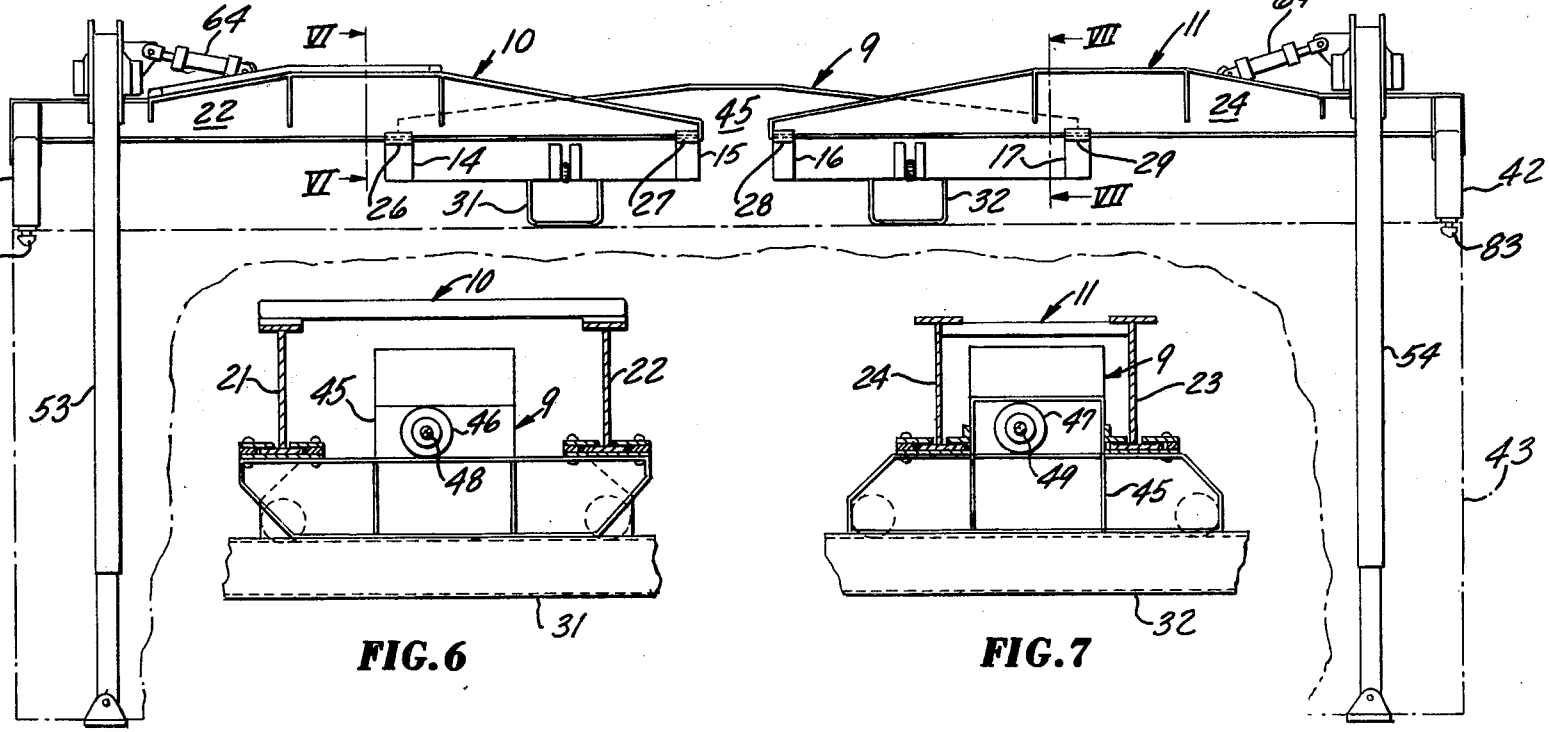
FIG.5
FIG.7
FIG.6

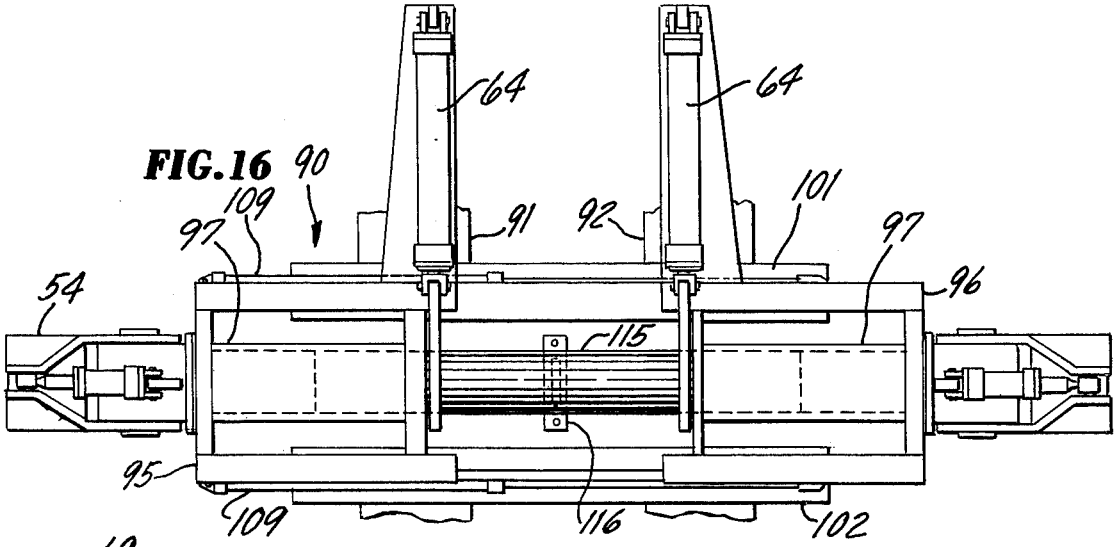
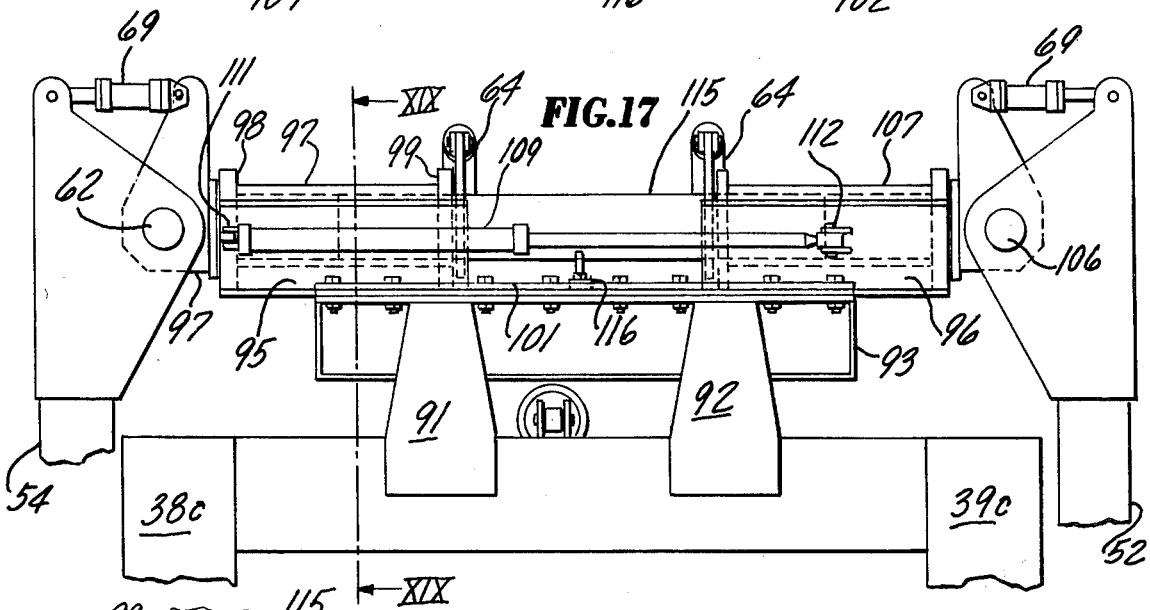
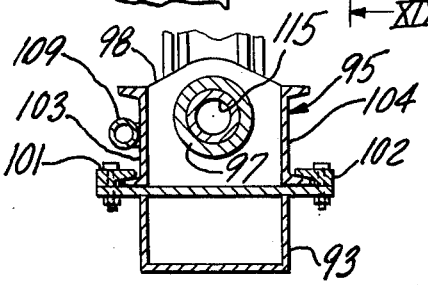
FIG.19
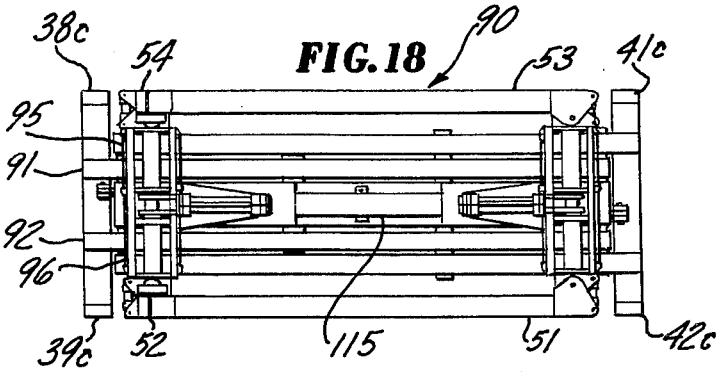

GRAPPLER SPREADER WITH OVERHEAD GRAPPLING ARM STORAGE

BACKGROUND OF THE INVENTION

In railway and marine cargo terminals which handle a mixture of cargo containers and piggyback trailers, the use of front and side loading carriers is found advantageous because of their considerable mobility and accessibility to containers or trailers in a great variety of positions and surroundings. The utilization of these expensive vehicles may be improved if they may be provided with suitable spreader equipment to stack and unstack containers in a very dense arrangement, i.e., in rows of stacked containers with the row side-by-side with substantially no spacing therebetween. In this situation, a carrier equipped with a conventional "top-lifting" spreader, i.e., one limited in use to handling cargo containers only, is satisfactory for shifting the containers from the stacks to the hauling vehicles or vice versa.

If use of the carrier is suddenly required for the handling of the piggyback trailer, the carrier must be re-equipped with a trailer-handling implement providing grappling arms. Grappler-spreaders which handle both containers and trailers have not been suitable for such alternate service because of the protrusion of the "far side" grappler arms beyond the horizontal periphery of the top lifting spreader. Expressed another way, the grappling arms of the grappler spreader on the side thereof away from the carrier project horizontally beyond a vertical projection of a container top and thus interfere with containers stacked at a higher level than the level at which the grappler spreader is operated. The use of such a grappler spreader requires that the rows of stacked containers must be spaced a substantial distance apart to prevent interference of the grappling arms with stacked containers even though the grappling arms are always to a horizontal operative position. This is an unacceptable mode of stacking as stacking space is at a premium in many container terminal yards.

It is an object of the present invention to provide the grappler spreaders of a type which have great flexibility in the handling of containers and piggy-back trailers under a great variety of terminal yard conditions whereby carrier equipment may be used without changes of alternate load-handling implements.

It is also an object to provide grappler spreaders which are suitable for handling substantially all lengths of commercially used cargo containers and piggyback trailers.

A further object is to provide an expandable grappler spreader of which the grappling arms thereof are accommodated within a vertical projection of an upward projection of the top periphery of the shortest container handled by the implement.

Another object is to provide a spreader in accordance with the foregoing objects providing a frame which may receive fork tines or other cantilever elements of a front end loaded or side loaded mobile carrier.

SUMMARY OF THE INVENTION

The invention resides in a grappler spreader of which the central improvement is structured permitting rotation of at least one pair of grappling arms at one side of the longitudinal axis of the spreader from their nearly vertical operative positions to upward horizontal inoperative positions, and then retraction while horizontally aligned within a vertical projection of the outer periphery of the grappler spreader or top periphery of a container handled thereby.

In general, such improved structure is obtained in a grappler spreader which has a base frame arranged along horizontal longitudinal and transverse axes with four latch housings located at corner extremities of a rectangle approximately outlining the frame. The latches projecting from such housings project downwardly below any other portion of the spreader. The grappler spreader further includes four grappling arms dependently attached to the base frame. At least two of the arms at one side of the longitudinal axis are connected to the base frame by supporting structure mounted on top of the main frame and extending laterally inwardly thereover. In principle, each of these two arms is carried on a trunnion which is received in a cage movable transversely of the main frame in guide relation therewith. As the trunnion is movable within the cage about an axis of rotation extending crosswise of the main frame, either of the two arms may be swung to a horizontal position generally above the main frame. Since the cage is movable transversely of the frame or beside a side member thereof, the arms may be positioned directly over the main frame within a vertical rectangular projection of its periphery.

The invention may occur in at least three embodiments, e.g., (1) the four grappling arms are mounted in pairs on two beams which move in their own longitudinal direction in transverse guide relation with the main frame; (2) one pair of arms on the "far side" of the main frame are each mounted on a separate beam which moves in transverse guide relation with the base frame, and the two "near side" arms are attached directly to the frame without provision for transverse movement; and (3) the four arms are attached to independent trunnion and supporting mechanisms in transverse guide relation with the base frame to affect storage of all four arms within a vertical projection of the main frame. These three general types of grappler spreaders may be constructed with a single section non-expandable frame, or a multiple section telescopically expandable frame. In the shorter versions of these implements, shortenable, e.g., telescoping arms facilitate the storage thereof over the base frame.

BRIEF DESCRIPTION OF THE DRAWINGS

FIGS. 4 and 5 are plan and side elevation views of the spreader of FIGS. 1 to 3 illustrating the grappler spreader in an extended arm-down condition adapting the implement for the handling of piggyback trailers.

FIG. 6 is a transverse section in elevation taken along the line VI—VI of FIG. 5.

FIG. 7 is a transverse section in elevation taken along line VII—VII of FIG. 5.

FIG. 16 is a fragmentary plan view of grappling arm supporting mechanism in accordance with the third described embodiment of the invention where in all grappling arms are laterally retractable and storable over the base frame of the grappler spreader.

FIG. 17 is a fragmentary elevation of grappling arms support structure in accordance with FIG. 16.

FIG. 18 is a plan view of a grappler spreader incorporating the grappling arm support structure of FIGS. 16, 17 and 19 illustrating the implement in fully longitudinally contracted condition with the grappling arms stored within the horizontal periphery of the main frame. FIG. 19 is a fragmentary section and elevation along line XIX—XIX of FIG. 17.

DETAILED DESCRIPTION OF THE PREFERRED EMBODIMENTS

EMBODIMENT A

Figure 1:
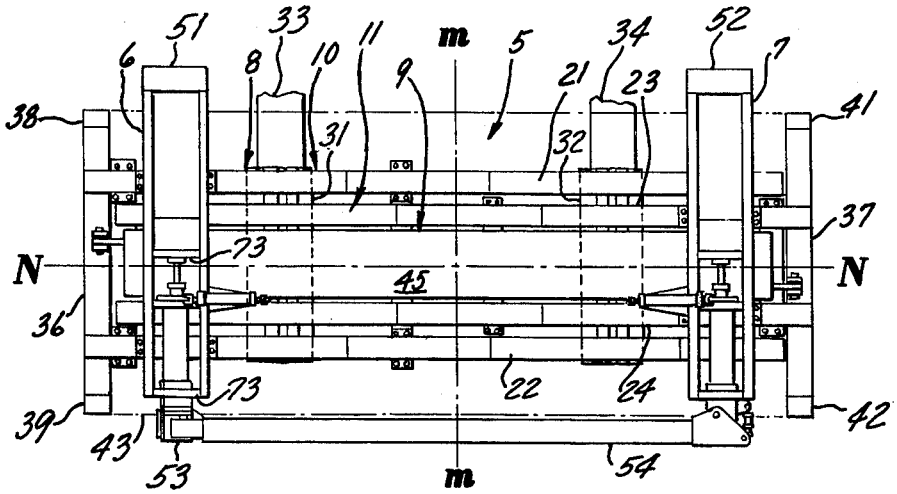
FIG. 1 is a plan view of an expandable grappler spreader in its most longitudinally contracted condition incorporating grappling arms in accordance with one embodiment of the invention shown upwardly retracted but in lateral projecting relation with the base frame.

The description below is directed to the disclosure of three embodiments of which FIGS. 1 to 12 relate to the first described embodiment. The basic concept depicted in these figures is a grappler spreader 5 which has grappling arms which are supported by pairs on two beams 6, 7 which extend in their longitudinal direction in traverse overhead relation with a main frame of the grappler spreader and are movable in such longitudinal direction to store the far side arms within a vertical projection of the periphery of the main or base frame for the top of the container handled thereby. In designating portions of grappler spreaders described herein with reference to a carrier, i.e., a front or a side-loading vehicle to which the grappler spreaders are attached normally by a fork lift mechanism, far side indicates the side of the container further away from the carrying vehicle and "near side" designates that side of the grappler spreader closer to and facing such vehicle.

The spreader illustrated in FIGS. 1 to 12 has a main frame 8 comprising three sections of which the center or base section 9 supports right and left cantilever sections 10, 11. The base section 9 comprises cross members 14, 15, 16, 17 on which longitudinal girders or beams 21, 22 of section 10, and longitudinal girders or beams 23, 24 of section 11 are supported thereover by a plate bearings fixed to the cross members, such as bearings 26, 27, 28, 29 which limit the cantilever sections to longitudinal movement relative to the base section 9. Since a primary use of the grappler spreaders described herein is in combination with front end or side loading vehicles, the base section 9 further comprises a pair of box channels 31, 32 extending in parallel equal distant or symmetric relation with the transverse axis M,M of the implement. The channels 31, 32 have a cross section parallel to the longitudinal axis and of the channels to receive the times 33, 34 of a fork lift mechanism mounted on the carrier.

Figure 2:
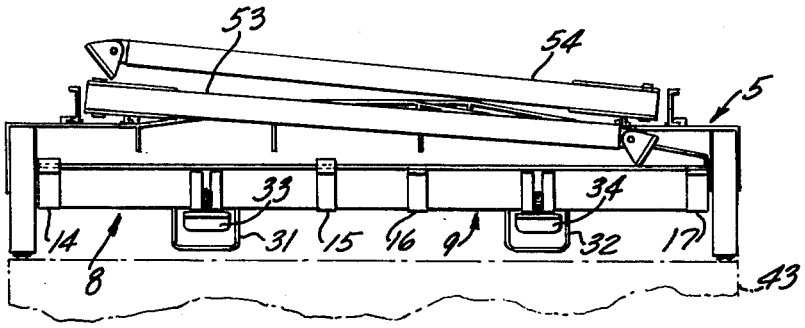
FIG. 2 is a side elevation of the grappler spreader shown in FIG. 1.
Figure 3:
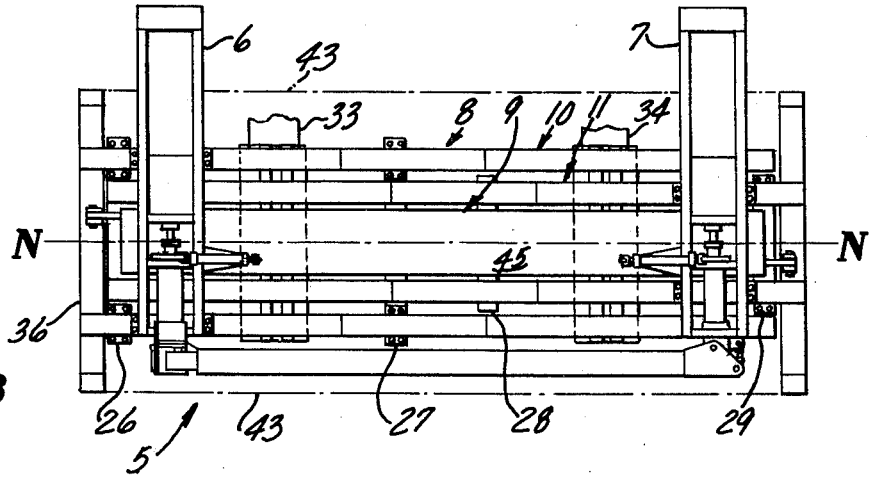
FIG. 3 is a plan view of the grappler spreader of FIGS. 1 and 2 showing the grappling arms in a laterally retracted stored position adapting the spreader for container handling activity.

As shown, the three sections of the main or base frame are proportioned so as to be substantially coextensive at the contracted condition of FIGS. 1 to 3, and to be maximally expansible to the condition as shown in FIGS. 4 and 5. Cantilever sections 10 and 11 comprise end beams 36, 37, respectively, which support and space latch housings 38, 39, 41, 42 in the outer horizontal periphery of the main frame as approximately exemplified by the outer rectangular periphery 43 of the top of a container.

The center section 9 of the main frame has as its principal elements a girder 45 of rectangular of box transverse cross section and of whale-back or arched upper surface. The girder 45 thus encloses an interior region of substantial size and which is housed in its cylinder portions 46, 47 of power cylinder units having piston rods 48, 49, respectively, attached to end beams 36, 37, respectively. With cylinders 46, 47 secured within the girder 45, frame sections 10, 11 may be adjusted to any container length in arrangement, e.g., from 20 to 40 feet. It will be noted that while the frame sections 10, 11 telescope within the length of center section 9, section 11 is narrower and of less height than section 10, as may be seen from FIGS. 6 and 7, and thus telescope within the section 10.

Figure 8:
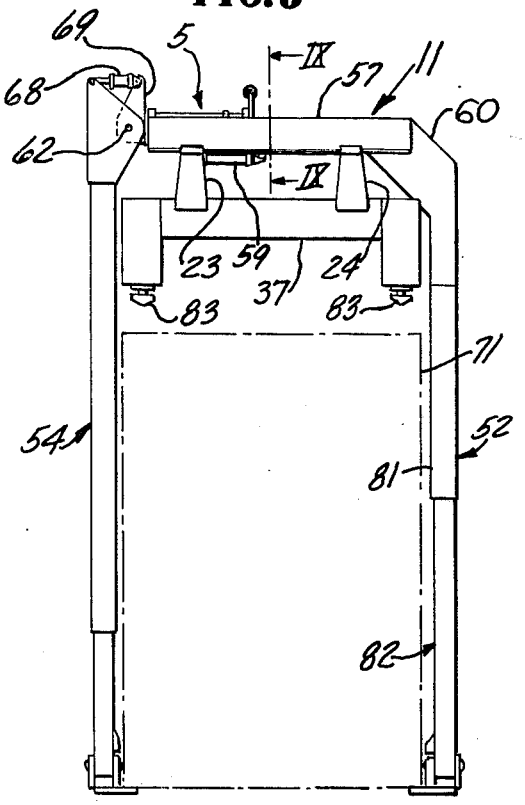
FIG. 8 is an end view of the implement of FIGS. 1 to 7 showing the grappling arms in extended down position adapting the implement for handling piggyback trailers.
Figure 9:
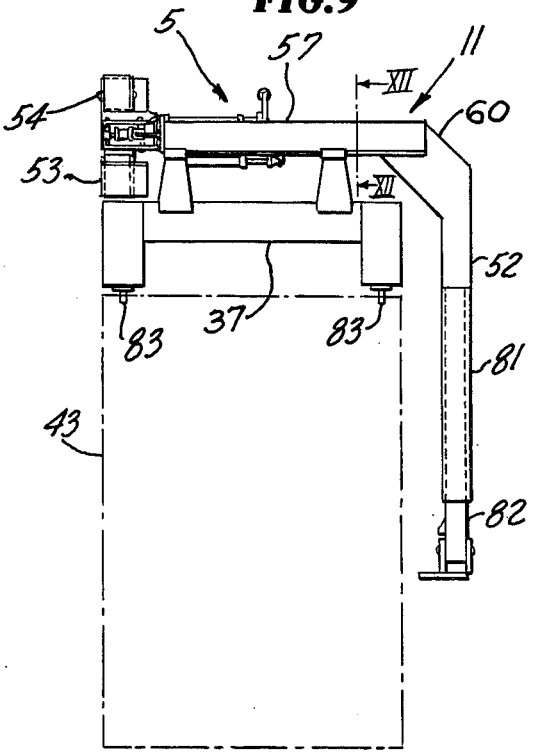
FIG. 9 is an end view of the grappler spreader of FIGS. 1 to 8 showing the implement with far side grappling arms raised and laterally retracted, and the near side arms longitudinally shortened thereby conditioning the implement for handling cargo containers.
Figure 10:
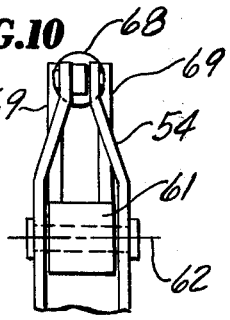
FIG. 10 is a fragmentary end view of grappling arm splaying mechanism.
Figure 11:
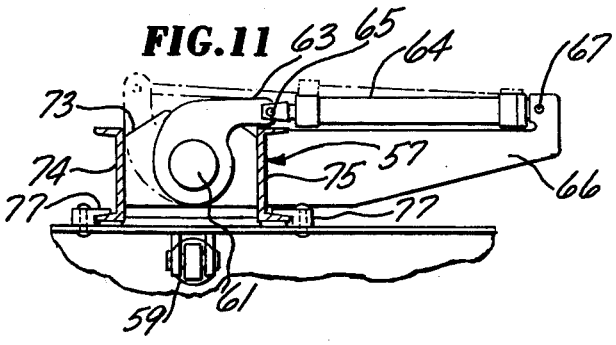
FIG. 11 is a fragmentary section in elevation taken along line IX—IX of FIG. 8 illustrating trunnion-rotating mechanism for the grappling arms.

Looking now to the main improvement involved in the invention, FIG. 4 illustrates that the grappling arms consist of near side arms 51, 52 and far side arms 53, 54 which are arranged in two pairs, each pair at one end of the base frame consisting of one near side arm and one far side arm supported a movable beam. For example, frame section 10 supports arms 51, 53 attached at their proximal ends to opposite end portions of a horizontally extending beam 56. In a like manner, arms 52, 54 are attached to a beam 57. The beams 56, 57 are supported on frame sections 10, 11 respectively in overhead bearing relation therewith for slidable movement in their longitudinal directions transversely of respective frame sections along axes parallel to transversely of respective sections along axes parallel to transverse axes M,M as shown in FIGS. 8 and 9. A power cylinder unit 59 attached at one end to longitudinal girder 23 and at the other end to the underside of the beam 57 may be operated by well known control means at the will of an operator either or both pairs of arms.

Figure 12:
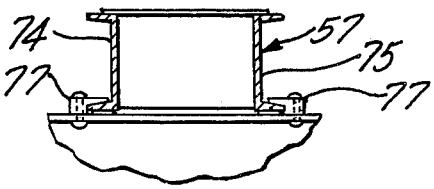
FIG. 12 is a fragmentary elevation in section taken on line XII—XII illustrating grappling-arm support-beam construction.

As shown in the embodiment of FIGS. 1 to 12, the far side arms 53, 54 attached to each beam is pivotal to an approximately horizontal position above the main frame. The near side arm attached to each beam is fixed rigidly thereto, e.g., in a non-flexible joint such as shown at 60. In the use of the grappler-spreader 5 in combination with a front end loading vehicle, room for the near side arm to move away from the load pickup region is easily provided with the result that there is no need to swing the arms 51, 52 in any direction. Clearance of the arms 51, 52 with the loading region is obtained solely by movement of the assembly comprising respective beams 56, 57, the near side legs, and the far side legs when the latter are raised to horizontal positions. Arms 53 and 54 are raised to the approximately horizontal positions by mechanisms shown in FIGS. 3 and 9 wherein. e.g., a trunnion 61, connecting with arm 54 at a pivotal splay axis 62 (see FIG. 8)(and FIG. 10) extending transversely to the axis of rotation of the trunnion, is rotated by a lever 63 fixed to the trunnion and a power cylinder unit 64 connecting with the lever 65 and to a bracket 66 at point 67. The bracket 66 is fixed to the beam 57 in transverse relation therewith. A splaying power unit 68 acts between a trunnion extension 69 and an end portion of the arm 54 to execute swinging movements of the arm 54 toward and away from the loading region occupied by trailer 71. The connection of the arm 54 with the splaying power unit and the trunnion 61 is further illustrated in FIG. 10. The trunnion 61 is supported within the beam 57 by means that the plurality of bearing and web elements 73 fixed tranversely within the beam functioning also to tie together, e.g., a pair of channels 74, 75, providing the principle longitudinal members of any of the arm-supporting beams. The arm supporting beams are secured in movable relation with frame section elements of respective section by bearing elements such as overlapping bars 77 which extend in entrapping relation with flanges of the channels 74, 75. (FIG. 12).

It may be noted especially from FIG. 8 that arms 52, 54 are fully extended to the same length but that arm 52 is capable of greater longitudinal contraction as a result of the manner in which the lengths of its telescoping portions 81, 82 are proportioned. Arms 51, 52 are shortenable for a different reason than arms 53, 54; namely, to retract the bottoms of the arms to such a height as to cause no obstruction in the handling of cargo containers interlocked with latches 83. Arms 53, 54 are shortenable, especially on expandable spreaders which must be shortened on occasion to lengths of 20 feet, so that the arms 53, 54 when raised to their horizontal inoperative positions and then laterally retracted as shown in FIG. 9, are shortenable to an extent that they do not reach or in any other way interfere with latch beams 36, 37. Telescopic retraction of the arms for this purpose is ordinarily less in that required for the purpose of maintaining clearance with downwardly depending arms in container operation.

In changing the grappler spreader 5 from piggyback trailer handling conditions to cargo container handling capabilities, the grappler spreader is manipulated from the configuration of FIG. 8 to that of FIG. 9. If implement 5 is already in its longitudinally contracted condition, it will be necessary first to longitudinally shorten the arms 53, 54 by mechanisms such as disclosed in U.S. Pat. Reissue No. 27,905. The arms may then be rotated through operation of trunnion rotating cylinder units corresponding to units 64, to bring the arms 53, 54 to the horizontal position illustrated by FIGS. 1 and 2. As the arms 53, 54 still project beyond a vertical projection of the load region grappler spreader periphery 43 as shown in FIG. 1, the arms may be transversely shifted to positions within a vertical projection of the periphery as illustrated in FIG. 3 by actuating cylinder units, e.g., unit 59, for traversing arm-supporting beams 56, 57. The near side arms 51, 52 are by now shifted laterally to a position away from load region 43 as shown in FIG. 9. Thereafter they may be shortened to the length shown in FIG. 9 by internal power cylinder units disclosed in the above-identified reissue patent. If the grappler spreader 5 is extended as shown in FIGS. 4 and 5, arms 53, 54 may be rotated at their full length into horizontal positions and then shortened if the grappler spreader itself is shortened to the condition of FIGS. 1 to 3.

EMBODIMENT B

Figure 13:
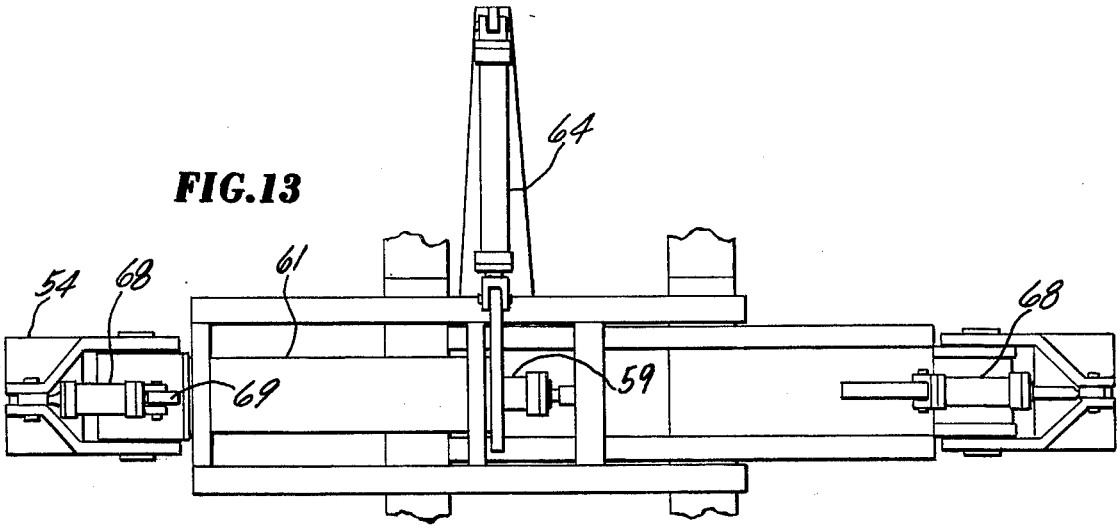
FIG. 13 is a plan view in accordance with another embodiment of the invention of structure for exclusively supporting the far side grappling arms for movements transversely of the base grappler spreader frame.
Figure 14:
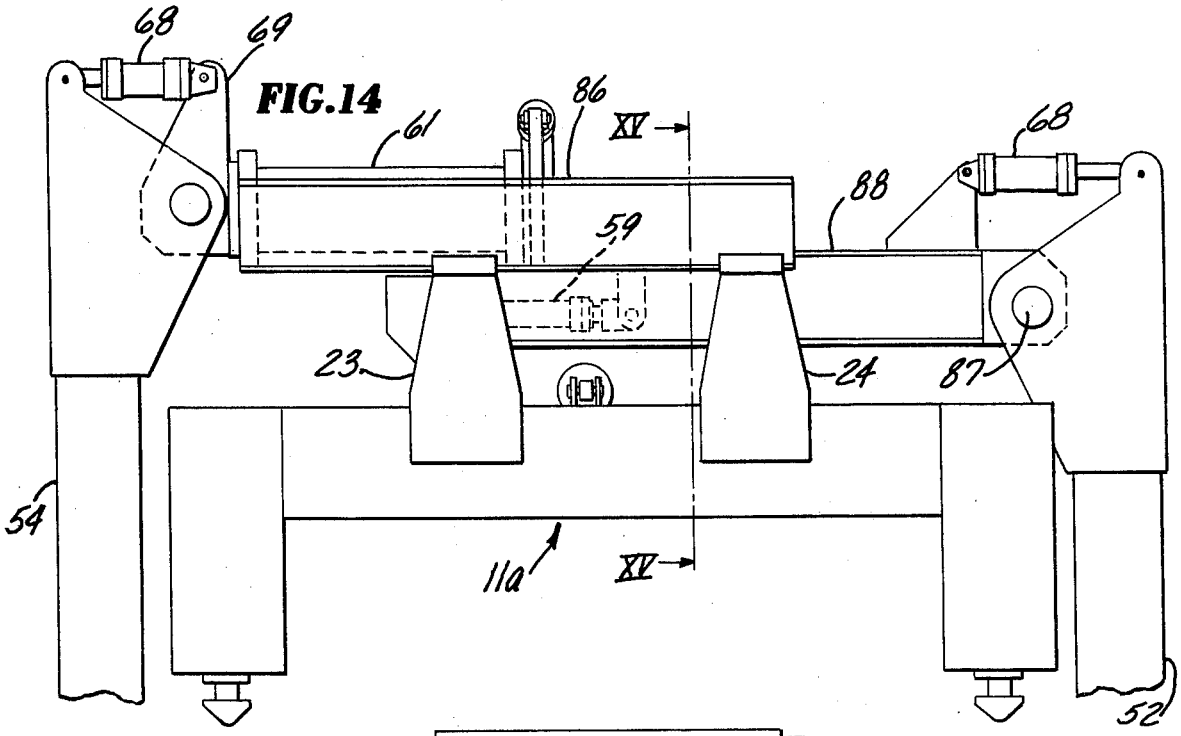
FIG. 14 is a fragmentary side elevation of the grappler arm support structure shown in FIG. 13.
Figure 15:
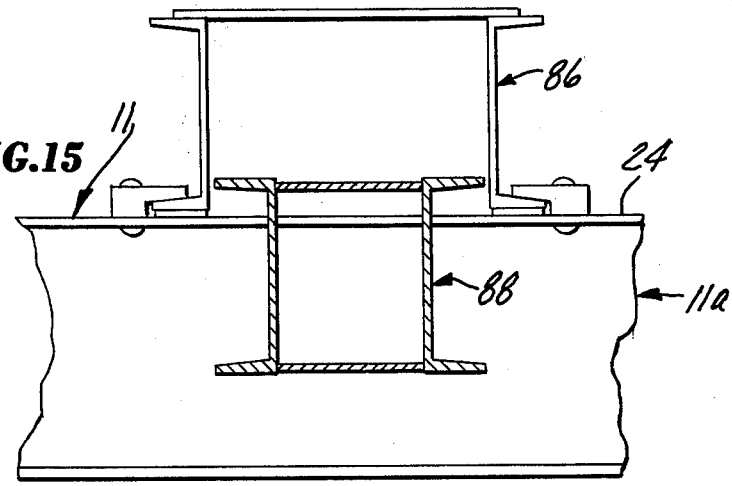
FIG. 15 is a fragmentary section in elevation taken along line XV—XV of FIG. 13.

FIGS. 13, 14, 15 illustrate an embodiment of the invention according to which a grappler-spreader is equipped with far side arms which are rotatable on trunnions mounted in transversely slidable beams which are swingable to horizontal positions and transversely movable over the top of the grappler spreader or base frame to inoperable stored positions within a vertical projection of the periphery main frame, or a cargo container load region directly thereunder, in essentially the same manner as heretofore described with respect to embodiment A. The essential difference is in the support on the main frame for the near side arms is fixed thereto which cannot shift laterally with the base frame in concert with movement of the support for the far side arms. As shown in FIGS. 13, 14, the arm 54 is connected to trunnion 61 in the same manner as illustrated and described with respect to embodiment A herein. Trunnion 61, however, is cradled in a transversely extending beam 86 having a cross section similar to that of beam 57 described heretofore. Beam 86 is slidably secured to longitudinal girders 23, 24 as heretofore described with respect to embodiment A thereby enabling arms 53, 54 to be positioned over the main frame as shown in FIGS. 3. Near side arms 51, 52 on the other hand, do not change positions as the result of any change of position of arms 53, 54. Arm 52, for example, is mounted pivotally by a pin 87 on a beam 88 fixed to frame section 11. The arm 52 connected to beam 88 by a pivot joint may be connected also in a fixed joint such as illustrated at 59 in FIG. 8.

EMBODIMENT C

FIGS. 16 through 19 illustrate embodiment C according to which a grappler spreader 90, having longitudinal girders 91, 92 similar to beams of frame sections 10, 11 hereinbefore described, comprises support structure for the grappler arms which enables storage of all four grappler arms in inoperative positions overhead or beside the main or base frame of the implement within its outer periphery circumscribing container pickup latches depending from its four latch housings 38c, 39c, 41c, 42c. FIGS. 16 through 19 illustrate that the spreader frame has a transverse support beam 93 fixed to the girders 91, 92 which functions as a support for short beams or cages 95, 96 to which arms 52, 54 are attached. The structure for attaching the arm is to respective cages. Arm 54, for example, is pivotally connected by pin 62 to a trunnion 97 received within the cases 95 in a rotatable bearing relation with transverse web elements 98, 99 providing cross reinforcement of the cage. As shown in FIG. 19, the arm and cage assembly are secured in transverse guide relation with the main frame of the grappler spreader, i.e., to beams 91, 92, by bearing structures such as bar shaped bearings 101, 102 extending over bottom flanges of channels 103, 104 of the cage.

Arm 52 is connected to cage 96 in a similar manner. The arm as pivotally connected by pin 106 to a trunnion 107 secured in rotatable relation within the cage 96 as hereinbefore described with respect to the similar cage 95. As shown, the cage is confined to travel lengthwise of the beam 93 by bearings 101, 102. The arms, when raised to horizontal positions, are retracted transversely over the main frame to positions as shown on FIG. 18 by means such as a pair of power units 109. The cylinder of unit 109 is secured by its closed end at 111 to the cage 95 and by the distal end of its rod to cage 96 at 112. The unit 109 has sufficient expansion range to position arms 54, 52 in their outward positions as shown in FIGS. 16, 17 and at inward positions as shown in FIG. 18. As additional structure for sharing the beam and twisting forces imposed in transverse movement of the cages on the transverse beams 93 and the bearings fixed thereto, a cylindrical guide 115 is provided which has an outer cylindrical surface closely fitting the inner cylindrical surfaces of trunnions 97, 107. With lubrication as an aid, the trunnions to slide in both telescopic and rotational relation with the guide 115. The guide 115 is secured from longitudinal movement relative to the beam 93 by a bracket 116 secured to both the guide and the beam. As shown, grappler spreader 90 has a main or base frame comprising a center section and two cantilever sections similar to the frame of embodiment A already described. The invention, however, is readily embodied in a single section frame.

While it is stated herein that the grappler arms may be stored above the base frame of the grappler spreader at transversely retracted positions, the various embodiments are illustrated with the sides of the base frame indented sufficiently to receive the retractable arms within a vertical projection of the periphery of the base frame. For example, the outside girders or beams of the cantilever sections of the embodiments illustrated in FIGS. 3 and 18 are transversely inset to provide indentation of the base frame as to enable storage of the retractable arms within the space between such outside girders and the rectangular periphery of the base frame.

As shown in the drawing, the base frame provides connecting means for attachment of the grappler spreader to a carrier, such as channels 31, 32, arranged in equidistance or symmetry with respect to the transverse axis of the base frame and positioned with respect to the transversely retractable grappling arms and the support means therefor to enable free movement of the arms between all operative and stored positions.

What is claimed is:

1. A grappler spreader for handling cargo containers and piggyback trailers comprising:

a base frame arranged along a rectangle having horizontal, longitudinal and transverse axes or directions and comprising downward projecting latch means located immediately within each of four corners of said rectangle approximately outlining the outer extremities of the frame and projecting downwardly below any other portion of the spreader for detachably interlocking with a cargo container, said frame comprising rigid means at opposite ends thereof for transversely spacing said latch means;

four grappling arms and supporting means therefor, said supporting means being mounted atop said frame and extending transversely inwardly thereover, said supporting means for each of two arms at one side of said longitudinal axis comprising a first portion fixed to said base frame in transversely inserted relation to the periphery of said rectangle, and a second portion connected directly to the arm and movably connected with said first portion in guide relation therewith for movement relative to the first portion in a direction transversely of said base frame, said second portion comprising means rotatable relative to the first portion about a crosswise axis extending tranversely of the base frame through at least 90 degrees to enable rotation of the arm attached thereto from a vertically extending alignment position to an approximately horizontally extending alignment position generally parallel to said longitudinal axis above the base frame;

said second portion being laterally retractable on said first portion to dispose both of said two arms transversely inwardly within a vertical projection of said rectangle;

said two arms at said one side of said longitudinal axis being in overlapping relationship to one another in said horizontally extending alignment position;

said supporting means for said two arms at said one side of said longitudinal axis including means for moving said two arms toward and away from said longitudinal axis with said two arms in said vertically extending alignment position for gripping and releasing containers.

2. The grappler spreader of claim 1 wherein:

the construction of said supporting means for the remaining two arms at the other side of said longitudinal axis comprises said supporting means construction defined for said first named two arms.

3. The grappler spreader of claim 1 wherein:

said four arms consist of two pairs, each pair has its arms on opposite sides of said longitudinal axis, and said second portion of the supporting means comprises a cross beam for each pair in slidable relation with the first portion, each of said cross beams supports one of said pairs of arms for simultaneous movement transversely of the said base frame.

4. The grappler spreader of claim 1 wherein:

said frame comprises a center section and two cantilever sections of length substantially equal to said center section and connected to the center section in guided relation therewith for movement lengthwise of said longitudinal axis from a substantially coextensive condition of all three sections to a condition wherein substantial portions of the cantilever sections project beyond both ends of the center sections;

said grappler arms comprising longitudinally telescopic portions enabling contraction of said arms within the distance between said rigid means at opposite ends of the spreader in its most longitudinally contracted condition;

said frame sections comprising longitudinal members spaced and confined within a dimension extending laterally of the spreader sufficiently less than the length of said rigid means to provide a space within said rectangle and laterally exteriorly of said longitudinal members to receive said grappler arms.

5. The grappler spreader of claim 4 wherein:

said center section comprises an elongate box center girder and a plurality of transverse cantilever beams fixed to and spaced along a girder;

and said cantilever sections each comprises a pair of girders at opposite sides of said box girder in overlying bearing relation with said cantilever beams;

said box girder rising between said pairs of girders of said cantilever sections to define an elongate enclosure; said spreader including fluid power units mechanically connected to said center girder and the outboard ends of said cantilever girders, said power units comprising cylinder portions at least partially housed within said enclosure.

6. A grappler spreader for handling cargo containers and piggyback trailers comprising:

a base frame arranged along a rectangle having horizontal, longitudinal and transverse axes comprising a center section and two cantilever sections of lengths substantially equal to said center section and connected to the center section in guided relation therewith for movement lengthwise of said longitudinal axis from a substantially coextensive condition of all three sections to a condition wherein substantial portions of the cantilever sections project beyond both ends of the center section;

said center section comprising an elongate center box girder and a plurality of transverse cantilever beams fixed to and spaced along said girder;

said cantilever sections each comprises a pair of girders at opposite sides of said box girder and overlying bearing relation with said cantilever beams;

said box girder rising between said pairs of girders of said cantilever sections and extending longitudinally to define an elongate enclosure;

said grappler spreader including fluid power units mechanically connected to said center section and two outboard ends of said cantilever sections;

four grappling arms and supporting means therefor, said supporting means being mounted on top of the girders of said cantilever sections and extending transversely thereover in clearance with said box girder at the most longitudinally contracted condition of the grappler spreader, said supporting means of each of two arms at one side of said longitudinal axis comprising a first portion fixed to the respective cantilever section in transversely inserted relation to the periphery of said rectangle, and a second portion connected directly to the arm and movably connected with said first portion in guide relation therewith for movement relative to the first portion in a direction transversely of the said base frame, said second portion comprising means rotatable relative to the first portion through at least 90 degrees about a crosswise axis extending transversely of the base frame to enable rotation of the arm attached thereto from a vertically extending alignment to an approximately horizontally extending alignment generally parallel to said longitudinal axis above the base frame;

said second portion being laterally retractable on said first portion to transfer both of said two arms to positions between transversely outside of a vertical projection of said rectangle and inwardly of said vertical projection.

7. The grappler spreader of claim 6 wherein:

said girder of the cantilever sections are spaced and confined within a transverse dimension of the grappler spreader sufficiently less than the length of said rigid means to provide a space within said rectangle between a cantilever section girder and the periphery of the rectangle to receive said grappling arms.

8. The grappler spreader of claim 6 wherein:

said second portion of each supporting means and the associated grappling arm comprises, and joins in, a pivot joint having a pivotal axis in transverse relation to said crosswise axis to enable swinging of said two arms toward and away from said vertical projection.

* * * * *